US009289912B2

(12) United States Patent
Bayzelon et al.

(10) Patent No.: US 9,289,912 B2
(45) Date of Patent: Mar. 22, 2016

(54) APPARATUS AND METHOD FOR CUTTING FACESTOCK

(71) Applicant: ETI Converting Equipment, Boucherville (CA)

(72) Inventors: Francois Bayzelon, Chambly (CA); Eric Ouellet, Beloril (CA); Denis Blouin, St. Basile-le-Grand (CA); Jean-Francois Poirier, Drummondville (CA)

(73) Assignee: ETI Converting Equipment, Quebec (CA)

( * ) Notice: Subject to any disclaimer, the term of this patent is extended or adjusted under 35 U.S.C. 154(b) by 321 days.

(21) Appl. No.: 13/956,873

(22) Filed: Aug. 1, 2013

(65) Prior Publication Data

US 2015/0033920 A1 Feb. 5, 2015

(51) Int. Cl.
*B26D 1/40* (2006.01)
*B26D 1/36* (2006.01)
(Continued)

(52) U.S. Cl.
CPC ..... *B26D 1/405* (2013.01); *B26D 1/365* (2013.01); *B26D 7/265* (2013.01); *B26D 7/2614* (2013.01); *B26F 1/384* (2013.01); *B26D 7/08* (2013.01); *B26D 2007/005* (2013.01); *B26F 2001/4463* (2013.01); *Y10T 83/04* (2015.04);
(Continued)

(58) Field of Classification Search
CPC ..... Y10T 83/0605; Y10T 83/483; Y10T 83/4838; Y10T 83/4844; Y10T 83/803; B65C 9/18; B65C 2009/1837; B65C 2009/1838; B26D 1/62; B26D 1/405; B26D 1/12; B26D 1/25; B26D 1/255; B26D 1/34; B26D 1/345; B26D 1/36; B26D 1/365; B26D 1/40; B65H 35/08; B26F 1/384
See application file for complete search history.

(56) References Cited

U.S. PATENT DOCUMENTS 2,138,406 A * 11/1938 Huck ..... B65H 35/08 271/206
3,566,734 A * 3/1971 Robinson ..... B26F 1/384 493/60

(Continued)

FOREIGN PATENT DOCUMENTS

JP 4245087 B2 3/2009

OTHER PUBLICATIONS

International Search Report mailed Apr. 10, 2014 in corresponding PCT Application No. PCT/CA2013/000687.

(Continued)

*Primary Examiner* — Phong Nguyen
(74) *Attorney, Agent, or Firm* — Brian M. Dingman; Dingman, McInnes & McLane, LLP

(57) ABSTRACT

Apparatuses and methods for cutting a facestock on a liner. An anvil roller receives facestock on liner. A cutting roller, under a force, cuts facestock between the cutting roller and the anvil roller. At least one support roller supports the cutting roller and, optionally, the anvil roller, thereby distributing the force into two or more portions and/or subportions, in two or more directions. Apparatuses, methods and kits for preparing a cutting surface of a cutting roller in a facestock cutting apparatus, or for extending the usefulness of a cutting roller. An equalizer roller is provided in a position adjacent to the cutting roller. The equalizer roller has an equalizing surface having a hardness at least as hard as a hardness of the cutting surface. The cutting roller is rotated against the equalizer roller such that the cutting surface is equalized by the equalizing surface.

14 Claims, 6 Drawing Sheets

(51) Int. Cl.

| | |
|---|---|
| ***B26D 7/26*** | (2006.01) |
| ***B26F 1/38*** | (2006.01) |
| *B26D 7/08* | (2006.01) |
| *B26D 7/00* | (2006.01) |
| *B26F 1/44* | (2006.01) |

(52) U.S. Cl.
CPC ..... *Y10T 83/0605* (2015.04); *Y10T 83/303* (2015.04); *Y10T 83/4838* (2015.04)

(56) References Cited

U.S. PATENT DOCUMENTS

| | | | | |
|---|---|---|---|---|
| 3,826,165 | A | | 7/1974 | Currie et al. |
| 4,610,189 | A | | 9/1986 | Lombardo |
| 4,742,745 | A | * | 5/1988 | Cremona ..... B27L 5/08 83/344 |
| 4,759,247 | A | * | 7/1988 | Bell ..... B26D 7/2628 83/344 |
| 4,770,078 | A | * | 9/1988 | Gautier ..... B26D 7/2614 83/344 |
| 5,388,490 | A | | 2/1995 | Buck |
| 5,404,780 | A | * | 4/1995 | Berne ..... B26D 1/245 83/345 |
| 5,806,418 | A | | 9/1998 | Dillinger |
| 6,244,151 | B1 | | 6/2001 | Machamer et al. |

OTHER PUBLICATIONS

Written Opinion of the International Searching Authority mailed Apr. 10, 2014 in corresponding PCT Application No. PCT/CA2013/000687.

* cited by examiner

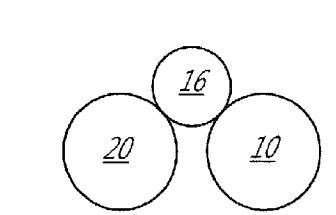
FIG. 4A
FIG. 4B
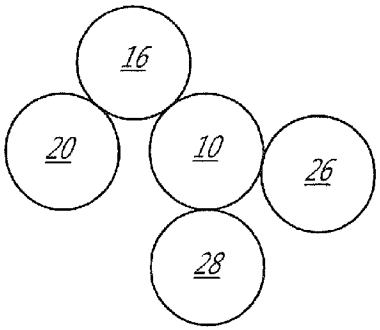
FIG. 4C
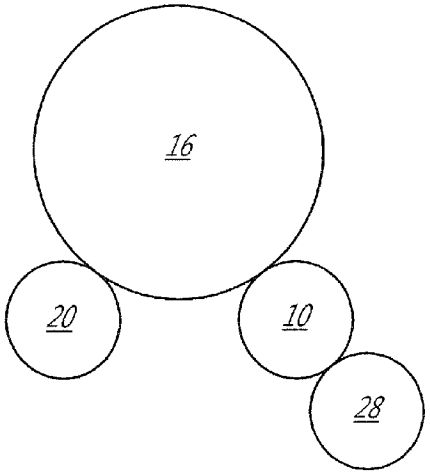
FIG. 4E
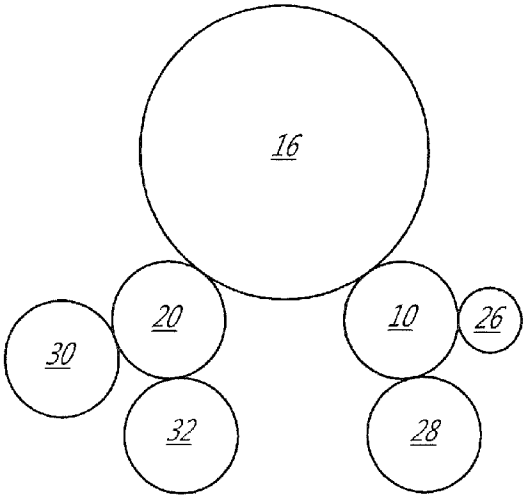
FIG. 4D

APPARATUS AND METHOD FOR CUTTING FACESTOCK

TECHNICAL FIELD

This invention generally relates to an apparatus and method for cutting label facestock on a liner and, more particularly, to an apparatus and method for cutting label facestock on a liner between an anvil roller and a cutting roller.

BACKGROUND

Various apparatuses and methods are known for cutting printed labels or other materials, referred to as facestock, which may have an adhesive layer and/or a silicon layer applied or coated thereon or adjacent thereto, on a backing or liner, as the facestock and liner pass over an anvil. Known methods involve the facestock and liner being fed between a rotating anvil roller and a rotating cutting roller. As the facestock passes between the anvil roller and the cutting roller, the cutting roller cuts the facestock into desired shapes or patterns.

As the cost of basic materials increases, so does the cost of liners, increasing the desirability of an apparatus and method which may be suitable for the use of thin or very thin liners. In addition to the advantage of reduced cost, employing such thin or very thin liners reduces waste and shipping costs, thereby reducing the environmental impact of the facestock cutting process.

One shortcoming of the apparatuses and methods known in the art is uneven precision of the cutting depth, particularly in applications where the use of a thin or very thin liner is desirable.

SUMMARY

The present invention seeks to improve precision of cutting depth when cutting facestock on a liner using an anvil roller and a cutting roller.

A first aspect of the present invention is directed to an apparatus for cutting a facestock on a liner. The apparatus comprises an anvil roller for receiving the facestock on the liner and a cutting roller under a force for cutting the facestock between the cutting roller and the anvil roller. The apparatus also comprises a first support roller for directly supporting the cutting roller such that the first support roller is under a first portion of the force while the anvil roller is under a second portion of the force.

Optionally, the apparatus may further comprise a first anvil support roller and a second anvil support roller for directly supporting the anvil roller such that the first anvil support roller is under a first subportion of the second portion of the force while the second anvil support roller is under a second subportion of the second portion of the force. The first and second anvil support rollers may further allow the anvil roller to support a negligible third subportion of the second portion of the force.

As an additional or complementary option, the apparatus may further comprise a second support roller and a third support roller for directly supporting the first support roller such that the second support roller is under a first subportion of the first portion of the force while the third support roller is under a second subportion of the first portion of the force. The second and third support rollers may further allow the first support roller to support a negligible third subportion of the first portion of the force.

The apparatus may also further comprise a force imparting member for imparting at least some of the force onto the cutting roller. The force imparting member may, as one of many options, comprise at least one pressure roller for directly imparting at least some of the force onto the cutting roller.

The cutting roller may further comprise a cutting surface for cutting the facestock and a contact surface for engaging an anvil contact surface on the anvil roller and for engaging a support contact surface on the first support roller. The facestock may thus be cut in a space between the anvil roller and the cutting roller, the space having a thickness that allows the facestock to be cut while not cutting through the liner. The axis of rotation of the cutting roller may be substantially vertical or substantially horizontal. The cutting roller may be a die-cutting roller that comprises a magnetic cylinder and a die plate for magnetically engaging the cutting roller and forming a cutting surface thereon.

In the apparatus, the axis of rotation of the anvil roller and the axis of rotation of the first support roller are, with respect to the force, below the axis of rotation of the cutting roller. Likewise, when the corresponding support rollers are present, the axes of rotation of the first and second anvil support rollers are below the axis of rotation of the anvil roller with respect to the force applied thereto and the axes of rotation of the second and third support rollers are below the axis of rotation of the first support roller with respect to the force applied thereto.

As an additional option, at least one of the anvil and the cutting rollers may be removable from the apparatus.

The apparatus may also further comprise an equalizer roller for equalizing a cutting surface of the cutting roller and adapted to be positioned adjacent to the cutting roller. The equalizer roller, if provided, has an equalizing surface having a hardness at least as hard as a hardness of the cutting surface. The equalizer roller may also optionally be adapted to be positionally interchangeable with the anvil roller.

A second aspect of the present invention is directed to a method of cutting a facestock on a liner. The method comprises receiving the facestock on the liner on an anvil roller and cutting the facestock between a cutting roller which is under a force, and the anvil roller. The cutting roller is directly supported by a first support roller, which is under a first portion of the force, while the anvil roller is under a second portion of the force.

The different options presented with reference to the first aspect of the invention are applicable, mutatis mutandis, to the second aspect.

More specifically, the method may optionally further comprise directly supporting the anvil roller with first and second anvil support rollers such that the first anvil support roller is under a first subportion of the second portion of the force while the second anvil support roller is under a second subportion of the second portion of the force. The method may also further comprise directly supporting the first support roller with second and third support rollers such that the second support roller is under a first subportion of the first portion of the force while the third support roller is under a second subportion of the first portion of the force. The method may also further comprise imparting at least a portion of the force onto the cutting roller using an imparting member. A contact surface on the cutting roller may engage a contact surface on the anvil roller and engage a contact surface on the first support roller.

The facestock may be cut in a space between the anvil roller and the cutting roller, the space having a thickness which is greater than or equal to the thickness of the liner, to allow the facestock to be cut while not cutting through the liner. The cutting roller may have an axis of rotation that is substantially vertical or is substantially horizontal. The cutting roller may also be a die-cutting roller comprising a magnetic cylinder, and the method may further comprise providing a die plate for magnetically engaging the cutting roller and for providing a cutting surface thereon.

With reference to the second aspect of the present invention, the method may further comprise, following wear of the cutting surface, replacing the anvil roller by another anvil roller of greater diameter.

The method may also optionally further comprise providing an equalizer roller in a position adjacent to the cutting roller, the equalizer roller comprising an equalizing surface, the equalizing surface having a hardness at least as hard as a hardness of a cutting surface of the cutting roller and rotating the cutting roller against the equalizer roller, such that the cutting surface is equalized by the equalizing surface. The anvil roller and the equalizer roller may be adapted to be positionally interchangeable with one another.

A third aspect of the present invention is directed to a method of preparing a cutting surface of a cutting roller in a facestock cutting apparatus. The method comprises, in the facestock cutting apparatus, providing an equalizer roller in a position adjacent to the cutting roller, the equalizer roller comprising an equalizing surface having a hardness at least as hard as a hardness of the cutting surface and rotating the cutting roller against the equalizer roller such that the cutting surface is equalized by the equalizing surface.

Optionally, the equalizer roller may be adapted to be positionally interchangeable with an anvil roller and the method may further comprise receiving the facestock on the liner on the anvil roller and cutting the facestock between the cutting roller which is under a force, and the anvil roller. The cutting roller may be directly supported by a first support roller, which is under a first portion of the force, while the anvil roller is under a second portion of the force.

The equalizer roller may optionally be oversized relative to the anvil roller such that the equalizer roller equalizes the cutting surface to allow for use of a facestock and a liner of a desired thickness to be used such that the facestock is cut and the liner is not cut through during cutting of the facestock. The method may yet further comprise, as the cutting surface wears out, replacing the anvil roller by another anvil roller of greater diameter.

A fourth aspect of the present invention is directed to an equalizer roller for preparing a cutting surface of a cutting roller in a facestock cutting apparatus. The equalizer roller comprises an equalizing surface having a hardness which is greater than or equal to a hardness of the cutting surface, such that when the equalizer roller is positioned adjacent to the cutting roller and the cutting roller is rotated against the equalizer roller, the equalizer surface equalizes the cutting surface. Optionally, the equalizer roller may be adapted to be positionally interchangeable with an anvil roller and the equalizer roller may have a radius at the equalizing surface that exceeds a radius of the anvil roller by a difference, such that the equalizer roller is adapted to modify the cutting surface, thereby resulting in a facestock cutting space between the anvil roller and the cutting surface.

A fifth aspect of the present invention is directed to a kit for preparing a cutting surface on a cutting roller in a facestock cutting apparatus. The kit comprises one or more of the equalizer rollers of the fourth aspect of the present invention and two or more anvil rollers which are configured to be positionally interchangeable with the one or more equalizer rollers and with each other. The anvil rollers of the kit have sequentially differing diameters with respect to one another, such that, in response to wear on the cutting surface and a resulting increase in the cutting space between the anvil roller and the cutting surface, the anvil rollers allow for sequential replacement by a subsequent anvil roller in order of sequentially increasing size.

The kit may further comprise five anvil rollers and the anvil rollers may differ sequentially in radius by 3 micrometers.

A sixth aspect of the present invention is directed to an apparatus for cutting a facestock on a liner. The apparatus comprises an anvil roller, a cutting roller, a first support roller, a first anvil support roller and a second anvil support roller. The anvil roller is for receiving the facestock on the liner. The cutting roller is under a force and is for cutting the facestock between the cutting roller and the anvil roller. The first support roller is for directly supporting the cutting roller such that the first support roller is under a first portion of the force while the anvil roller is under a second portion of the force. The first anvil support roller and the second anvil support roller are for directly supporting the anvil roller such that the first anvil support roller is under a first subportion of the second portion of the force while the second anvil support roller is under a second subportion of the second portion of the force. The first and second anvil support rollers allow the anvil roller to support a negligible third subportion of the second portion of the force.

Optionally, the apparatus may further comprise a second support roller and a third support roller for directly supporting the first support roller such that the second support roller is under a first subportion of the first portion of the force while the third support roller is under a second subportion of the first portion of the force. The second and third support rollers may thus allow the first support roller to support a negligible third subportion of the first portion of the force.

The apparatus may also optionally further comprise an equalizer roller, adapted to be positionally interchangeable with the anvil roller, for equalizing a cutting surface of the cutting roller, the equalizer roller having an equalizing surface having a hardness at least as hard as a hardness of the cutting surface. The equalizer roller may be adapted to be positioned adjacent to the cutting roller.

BRIEF DESCRIPTION OF THE DRAWINGS

FIGS. 4A, 4B, 4C, 4D, 4E are schematic representations of elevation views depicting other exemplary apparatuses according to embodiments of the present invention.

DETAILED DESCRIPTION

Figure 1:
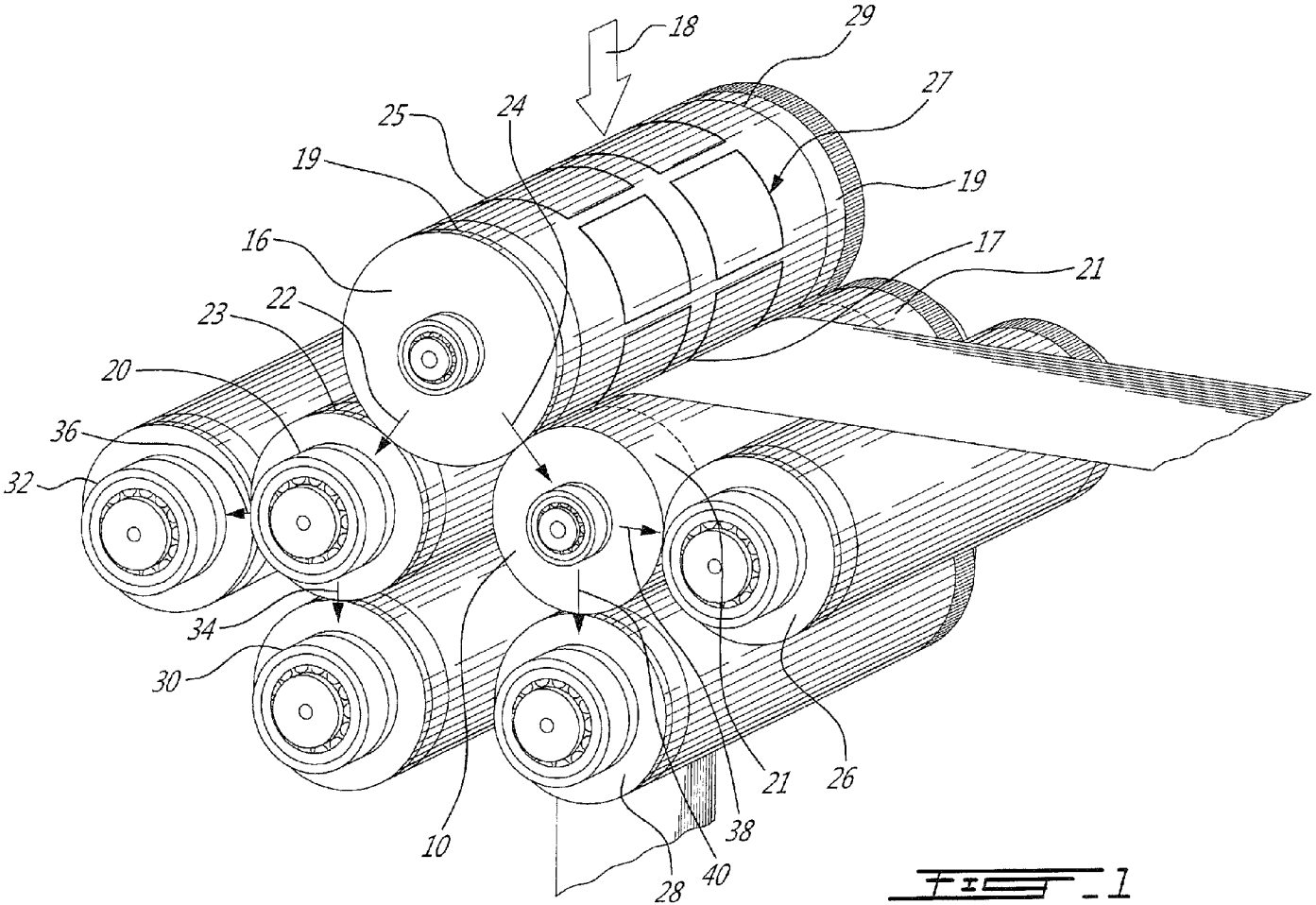
FIG. 1 is a perspective view depicting an exemplary apparatus according to one of the preferred embodiments of the present invention.
Figure 2:
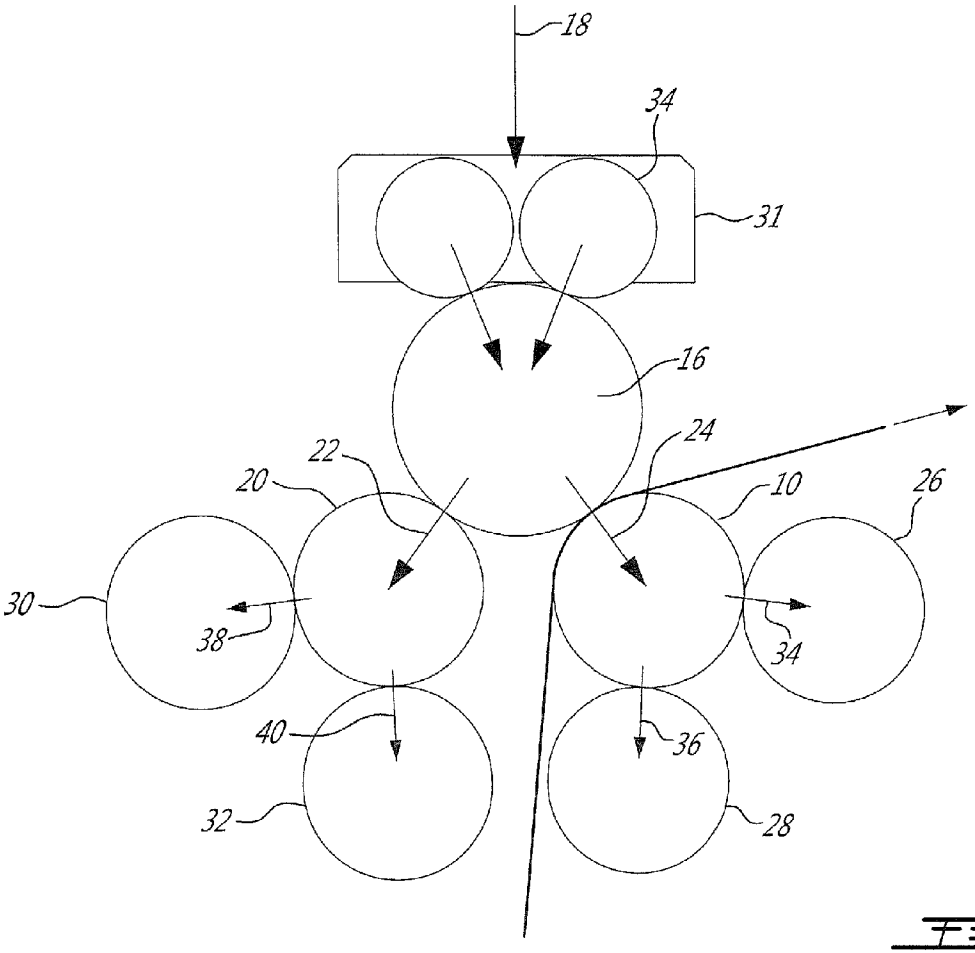
FIG. 2 is an elevation view depicting an exemplary apparatus according to one of the preferred embodiments of the present invention in greater detail.

Reference is now made to the drawings, in which FIGS. 1 and 2 show an apparatus 1 for cutting facestock on a liner. An anvil roller 10, which may be removable from the apparatus 1, is configured for receiving the facestock 12 on the liner 14

Figure 3:
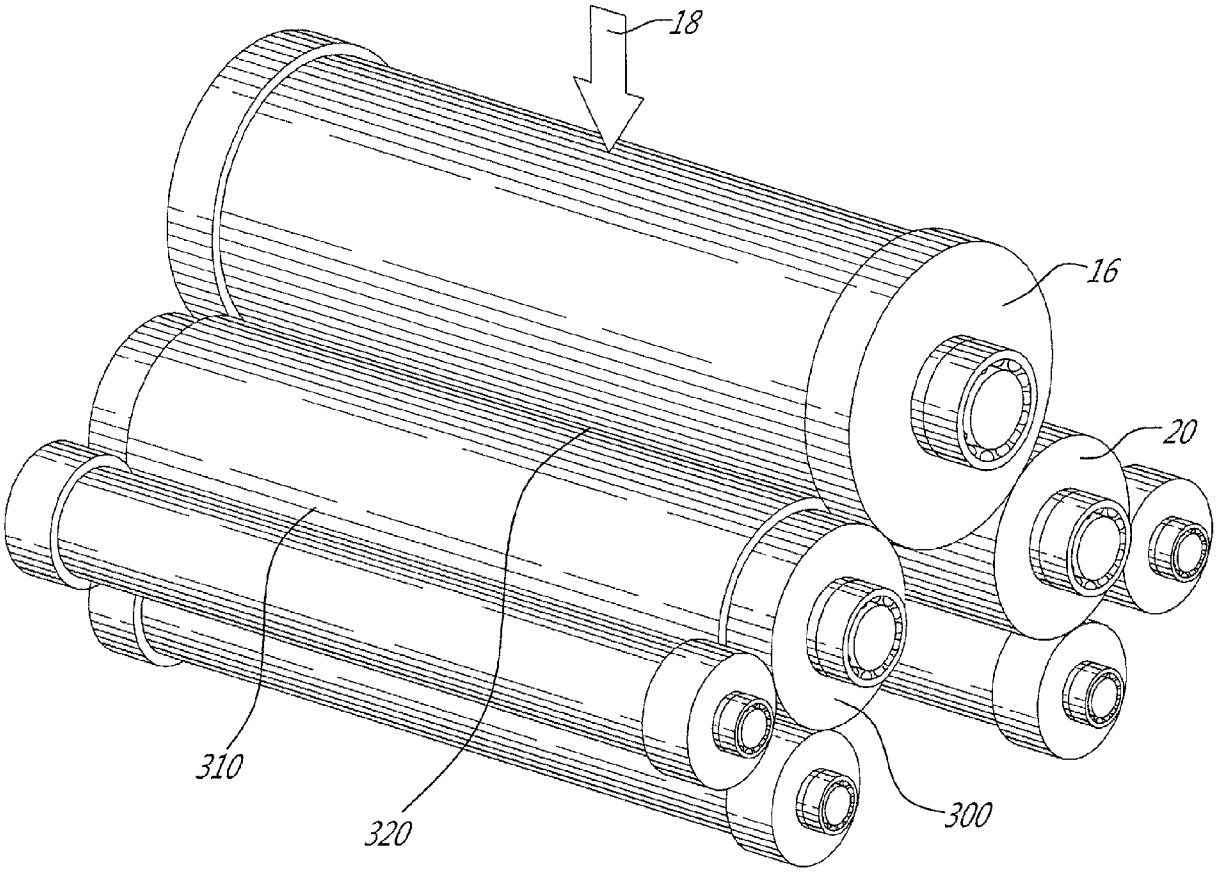
FIG. 3 is a schematic diagram view depicting an exemplary apparatus according to one of the preferred embodiments of the present invention.
Figure 3A:
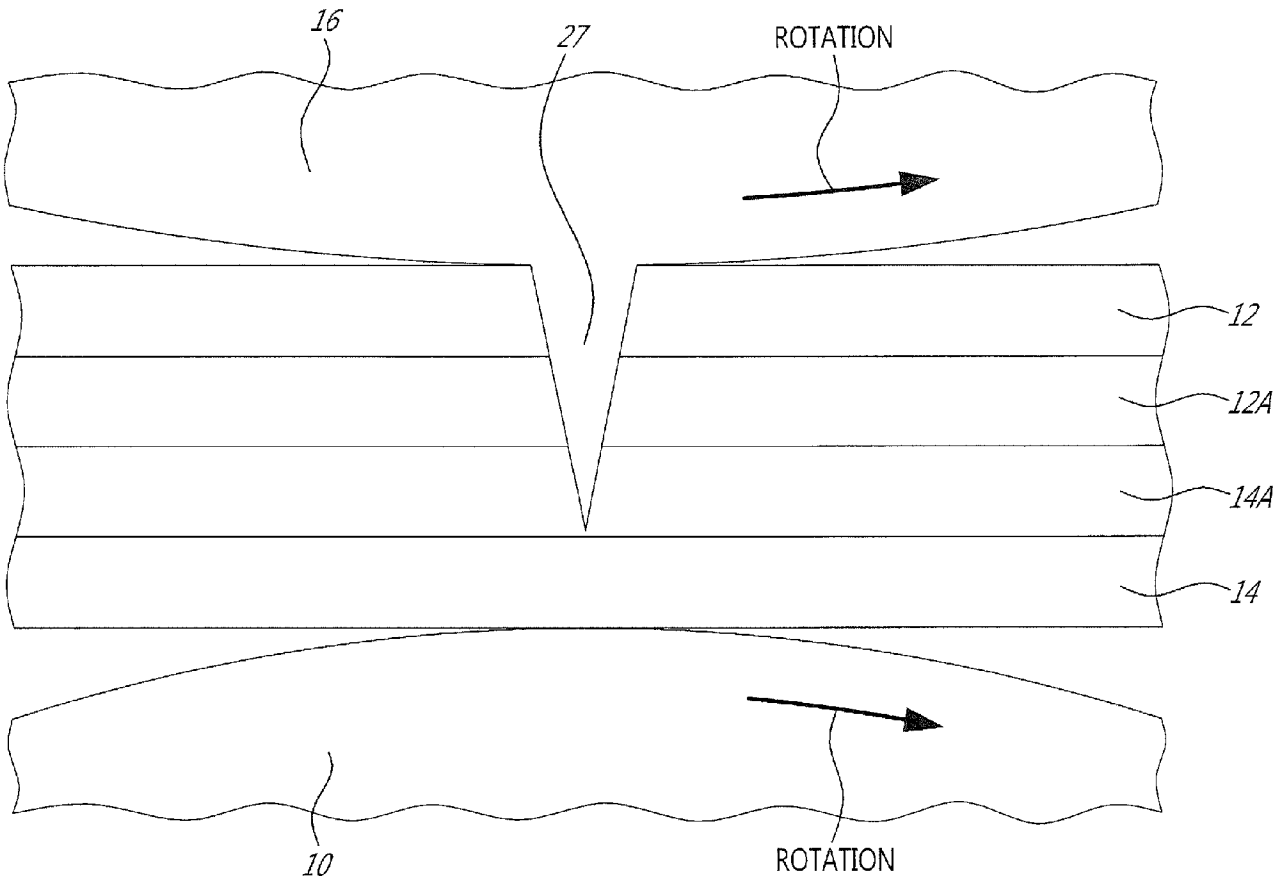
FIG. 3A is a schematic diagram view depicting an exemplary apparatus according to one of the preferred embodiments of the present invention in sectional view.

(not shown). Skilled persons will readily understand that the present invention focuses on the interface that allows cutting of the facestock 12 over the liner 14. With reference to FIG. 3A, label stock may be used to describe a typical embodiment in which the facestock 12 is provided over an adhesive layer 12A over an silicone layer 14A over the liner 14. The apparatus 1 of FIGS. 1 and 2 comprises a variety of different systems that are not affected by the present invention. Furthermore, it will be understood that the various elements are not drawn to scale, but that the features of the invention may have been magnified to illustrate the teachings of the invention. In the example of FIGS. 1 and 2, the facestock 12, which may also comprise the adhesive layer 12A, is provided as a long or continuous strip typically laminated on the liner 14, unwound from a roll. Other types of continuous feeding could be used as long as the facestock 12 over the liner 14 can be provided on a continuous basis. Once unwound from the roll, the facestock 12 on the liner 14 is moved along a path toward an anvil roller 10, which receives the facestock 12 on the liner 14. In the example of FIGS. 1 and 2, a cutting roller 16 is positioned adjacent to the anvil roller 10 and is under a force 18. The cutting roller 16 is configured for cutting the facestock 12 as the facestock 12 passes through a cutting space 17 between the anvil roller 10 and the cutting roller 16. The facestock 12 is cut, for example, into desired shapes to form labels or other end products or intermediary products.

The cutting roller 16 may be removable from the apparatus 1, may be a die-cutting roller, and may also be a magnetic cylinder having a die plate for magnetically engaging the magnetic cylinder to form a cylindrical cutting portion, which is at least partly surrounded by a cutting surface 27 for cutting the facestock 12. Skilled persons will readily understand that the cutting surface 27 may be described as a cutting edge or cutting edges, as the cutting surface 27 may comprise, for example, protruding edges of the die plate which may be formed appropriately to cut desired shapes and patterns into the facestock 12. The cutting roller 16 also has one or more contact surfaces 19 (also referred to as bearer surfaces) for engaging one or more contact surfaces 21 on the anvil roller 10 and for engaging one or more contact surfaces 23 on one or more first support rollers 20. For instance, the contact surfaces 19, 21 and 23 may be strips on the length of each roller 10, 16 and/or 20 that are set at a predetermined diameter for each respective roller. The different contact surfaces 19, 21 and 23 allow application and distribution of the force 18 throughout the apparatus 1 in a controlled manner. The contact surfaces 19 and 21 between the anvil roller 10 and the cutting roller 16, in the example of FIGS. 1 and 2, are formed by two strips at each end of the rollers 10 and 16. For instance, the maximum diameter of the cutting roller 16 may be set by its contact surfaces 19, while an area 25 for receiving the cutting surface 27 is provided between the two ends at a smaller diameter (the difference being shown at 29). The diameter of the contact surfaces 21 of the anvil 10 has to be set considering the parameters of the cutting roller 16 (e.g., diameter of the contact surfaces 19 and the cutting surface 27) the thickness of the liner 14, and the thickness of any adhesive layer 12A, and/or silicone layer 14A, if present. Different anvils (not shown) may be provided to account for different liner 14 thicknesses, different adhesive layer 12A thicknesses, if present, and/or silicone layer 14A thicknesses, if present, and different heights of the cutting surface 27 as it wears out over time.

The different rollers 10, 16 and 20 may be free rolling in the apparatus 1. However, a gear mechanism not shown in the example of FIGS. 1 and 2 may be further provided between the different rollers 10, 16 and 20 to ensure that some or all of the rollers 10, 16 and 20 rotate in sync. Skilled persons will recognize contexts in which the gear mechanism might be preferred or required (e.g., to more actively prevent skids between the anvil roller 10 and the cutting roller 16).

The first support roller 20 and the anvil roller 10 both directly support the cutting roller 16. In order to be able to distribute the force 18 throughout the apparatus 1, the axes of rotation of the anvil roller 10 and of the first support roller 20 are, with respect to the force 18, below the axis of rotation of the cutting roller 16. In this way, a first portion 22 of the force 18 is transferred from the cutting roller 16 towards the support roller 20, while a second portion 24 of the force 18 is transferred towards the anvil roller 10. A transfer of the force 18 into two portions 22, 24, in two directions, is thus achieved by configuring the cutting roller 16 such that it has at least two contact points, one with first support roller 20 and one with anvil roller 10.

The distribution of the force 18 toward more than one contact points on the cutting roller 16 has been shown to produce greater stability between the anvil roller 10 and the cutting roller 16, which in turns allow for greater precision in the cutting operation (e.g., using a structure as exemplified on FIG. 2).

With further reference to FIGS. 1 and 2, in the example depicted, a secondary level of support is provided for the anvil 10 and the first support roller 20. The exemplary secondary level of support means that the anvil roller 10 is further supported by first 26 and second 28 anvil supporting rollers, and the first support roller 20 is further supported by second 30 and third 32 support rollers. In this example, the first portion 22 of the force 18 is thereby divided into first 34 and second 36 subportions, each of which subportions is in different directions relative to one another. The second portion 24 of the force 18 is also divided into first 38 and second 40 subportions, each of which subportions is in different directions relative to one another. If the secondary level of support is provided, the axes of rotation of the first 26 and second 28 anvil support rollers are, with respect to the force 24, below the axis of rotation of the anvil roller 10 and the axes of rotation of the second 30 and third 32 support rollers are, with respect to the force 22, below the axis of rotation of the first support roller 20. In this way, the stability of the cutting roller 16 during use is increased by the increased stability of the anvil roller 10 and first support roller 20. Skilled persons will readily understand that the secondary level of support may be provided on the anvil roller 10 only or, likewise, on the first support roller 20 only (not shown).

In certain embodiments, the first and second anvil support rollers 26 and 28 are configured to allow the anvil roller 10 to directly support only a negligible third subportion of the second portion 24 of the force 18. Said differently, the force 24 is distributed in the forces 38 and 40 and, while pressure is exerted at the different contact surfaces (e.g., 21 and 19), the axis of the anvil roller 10 is not under significant force. For instance, this exemplary configuration may allow the anvil roller 10 to be provided with a different sets of bearings designed for stability considering the expected load thereon. In other non-mutually exclusive embodiments, the second and third support rollers 30 and 32 are configured to allow the first support roller 20 to support a negligible third subportion of the first portion of the force 22.

The axis of rotation of the cutting roller 16 may be substantially vertical (not shown) or horizontal. In certain embodiments, for example where the axis of rotation of the cutting roller 16 is substantially horizontal, the force 18 may be partly or entirely gravitational force. In the embodiment depicted in FIG. 2, at least a portion of the force 18 is imparted upon the cutting roller 16 by a force imparting member 31. The force imparting member 31 may include one, two, or more force imparting rollers or pressure rollers 34 (as exemplified on FIG. 2).

The facestock 12 is cut in a space 17 between the cutting roller 16 and the anvil roller 10. In certain embodiments, this space 17 is of a thickness which allows the facestock 12 to be cut by the cutting roller 16, while the liner 14 is not cut or is not destroyed to the point of losing its function of supporting the cut facestock 12 through the apparatus 1 and/or toward a subsequent process (e.g., to a labeling machine). In some cases, the cutting process can create a matrix of waste material surrounding the individual labels, which may be adhesive-backed. After the facestock 12 is cut on the liner 14, the liner 14 and the cut facestock 12, including the labels and any waste matrix passes to a station where the waste matrix is separated from the liner 14 and discarded (typically either rewound or vacuumed out for disposal). The cut facestock 12 (e.g., useful label) on the liner 14 is then passed to a subsequent process or rewound.

In many applications, it is desirable to use a thin or very thin liner 14. The use of a thin or a very thin liner 14 may provide environmental and cost advantages compared to thicker liners, since the thinner the liner 14, the less raw materials are likely used in its manufacture. Additionally, a thinner liner 14 likely has a reduced mass per surface area, which may further reduce shipping and waste disposal costs.

In a preferred embodiment of the apparatus 1 disclosed herein, liner 14 having a thickness which is less than or equal to 23 micrometers (μm, also still sometimes referred to as micron or μ) may be used. In another preferred embodiment, liner 14 having a thickness which is less than or equal to 18 micrometers may be used. In yet another preferred embodiment, liner 14 having a thickness which is less than or equal to 12 micrometers may be used. These thicknesses of 12, 18 and 23 micrometers are actual or developing industry standards. Skilled persons will readily understand that the liner 14 may also have a thickness over 23 micrometers and still be used in the context of the present invention.

Liner 14 suitable for use in association with the apparatuses and methods of the present invention may be filmic, and may be made of polymer materials, for example polyethylene terephthalate (PET) or biaxially oriented polypropylene (BOPP) or any other type of support material, for example, wood fiber or Kevlar™. With reference to FIG. 3A, facestock 12 suitable for use in association with the apparatuses and methods of the present invention may comprise an adhesive layer 12A applied thereon, and/or facestock 12 may be separated from the liner 14 by one or more adhesive layers 12A. The facestock 12 may additionally comprise a silicone layer 14A applied thereon and/or facestock 12 may be separated from the liner 14 by one or more silicone layers 14A.

The apparatuses and methods of the present invention are suitable for using thin or very thin liners 14 due to cutting depth precision. The precision is achieved, at least in part, due to the stability of the cutting roller 16 during use. As discussed above, the apparatuses of the present invention comprise a cutting roller 16 which makes contact with at least a first supporting roller 20 and with an anvil roller 10, imparting stability upon the cutting roller 16. Also as discussed above, in certain preferred embodiments, the apparatus 1 of the present invention also includes one or more additional supporting rollers 30, 32 for supporting the first supporting rollers 20, and additional anvil supporting rollers 26, 28 for supporting the anvil roller 10. In this way, the transfer and distribution of the force 18 into multiple portions and subportions, which are imparted upon multiple rollers, are expected to increase stability of the cutting roller 16 during use, and therefore the cutting depth precision, of the apparatuses of the present invention.

In certain preferred embodiments, additional stability and/or cutting precision may be achieved by a cutting roller 16 having a high mass (for example a mass of at least 200 kilograms, preferably between 225 kilograms and 275 kilograms). In certain embodiments, the circumference of the cutting roller 16 will approximate the width of the facestock 12 to be cut, and the mass of the cutting roller 16 will, accordingly, correspond generally with the width of the facestock 12 to be cut. In certain preferred embodiments, the cutting roller 16 has an eccentricity of less than or equal to 0.0001 inches, thereby further increasing cutting precision.

Cutting surfaces 27 may be manufactured with irregularities, or irregularities may arise in other ways, for example due to damage to the cutting surface 27 or to the manufacturing process for creating the cutting surface 27. These irregularities, which may also be referred to as burr on the cutting surface 27, may result in an inconsistent cutting surface 27 and therefore limit the cutting depth precision. With reference to FIG. 3, in certain embodiments, the apparatus 1 of the present invention includes an equalizer roller 300, alternatively referred to herein as an overcut tool, for preparing, or equalizing the tolerancing of the cutting roller 16 before use. For instance, the equalizer roller 300 may be used for equalizing, or smoothing irregularities or burr on the cutting surface to a desired tolerancing. In certain methods of use of the embodiment depicted, the equalizer roller 300 is configured to be positionally interchangeable with the anvil roller 10. Prior to use of the cutting roller 16, equalizer roller 300 is position adjacent to the cutting roller 16, and the cutting roller 16 is rotated (e.g., a minimum of one (1) complete rotation, typically two (2) complete rotations) such that the cutting surface 27 is against an equalizing surface 310 of the equalizer roller 300. The equalizer surface 310 has a hardness, which is at least as hard as a hardness of the cutting surface 27, and the rotation of the cutting roller 16 against the equalizer roller 300 therefore equalizes or, in other words, evens or levels, the cutting surface 27 by compressing the irregularities or burr of the cutting surface 27 to the desired tolerancing. In this way, the impact of any irregularities or burr on cutting depth precision may be reduced.

Once the cutting surface 27 is equalized, the equalizer roller 300 may be removed from the apparatus 1 and replaced with the anvil roller 10. Alternatively, in certain embodiments, the equalizer 300 may be left in the apparatus 1, but prevented from affecting the cutting surface 27, for instance, if the equalizer 300 has a dedicated position (not shown) in the apparatus 1 and the anvil 10 and the equalizer roller 30 are not interchangeable. While having the equalizer 300 roller and the anvil 10 at two different positions (not shown) in the apparatus 1 is technically achievable, skilled persons will readily acknowledge that it may be more difficult to maintain the required level of tolerancing in the cutting surface 27 (e.g., an additional force (not shown) may need to be provided to the equalizer 300 and the relative precision of the two different positions will be required to match). The anvil roller 10 is undersized relative to the equalizer roller 300 by a predetermined measurement, suitable to provide a cutting space between the anvil roller 10 and the cutting roller 16 of a desired thickness.

With reference to FIG. 3A, in some exemplary configurations, the cutting space equalized by the equalizer roller 300 is smaller than the thickness of the liner 14 by an appropriate number of micrometers that allows for cutting of the facestock 12, as well as cutting of any adhesive layer 12A and/or silicone coating or layer 14A, if either or both such layers 12A, 14A are present, without affecting the functional integrity of the liner 14. For example, by using a 3 micrometer undercut anvil roller 10, the cutting space is suitable to allow for the cutting of the facestock 12 and any adhesive and/or silicone layer 12A, 14A, if present, while the liner 14 is not improperly affected by the cut operation.

For instance, a typical label construction would likely comprise the facestock 12 (e.g., 25 micrometers thickness and up), an adhesive layer 12A (e.g., 15 to 20 micrometers) on the liner 14 (e.g., 12 to 23 micrometers or more that may include an optional silicone layer 14A towards the adhesive layer 12A). The cut operation is typically initially set so that the cutting surface 27 has a penetration no greater than 1 micrometer into the liner 14, which is achieved, as previously exemplified, by leveling the height of the cutting surface 27 with the equalizer 300. In this example, any protrusion under the leveled height would be untouched by the equalizer 300. From experience, it has been determined that the adequate results are achieved when the adhesive layer 12A is cut, which allows for expected stripping of the waste material. However, it is expected that skilled persons will be able to determine the permissibility of cutting depth between the adhesive layer 12A, the silicone layer 14A and the liner 14. More specifically, it is expected that different adhesive compositions and/or silicone coatings will create different results. For instance, a partial cut through 80% of the adhesive layer might still create viable waste stripping. On the other hand, a deeper cut into the liner 14 might still only compress the liner 14 without affecting its function. In the context of the present example, it has been determined experimentally that a 3 micrometer gap increase in the cutting height appears to revive the cutting surface 27 without affecting the liner 14's integrity.

In methods according to certain embodiments of the present invention, the anvil roller 10 may be replaced by sequentially larger anvil rollers 10, as required by wear on the cutting surface 27 over time and use. In certain preferred embodiments, once the cutting surface 27 is sufficiently worn (e.g., reduced cutting precision observed, predetermined number of cycles or time of use), the anvil roller 10 may be removed and replaced by an anvil roller 10 which is 3 micrometers larger in radius, thereby reducing the thickness of the cutting space 17 by 3 micrometers. This process may be repeated as the cutting surface 27 is worn down further with additional use.

In certain embodiments of the present invention, the anvil roller(s) 10 and/or the equalizer roller 300 have a surface roughness (Ra) measuring less than, or smoother than, 8 micro-inches (or μin), which could be obtained through grinding (could also be presented as 8G). In certain preferred embodiments, the anvil roller(s) 10 and/or the equalizer roller 300 have a surface roughness, which is lapped, and measures approximately equal to or less than or smoother than 4 micro-inches, which could be obtained through a lapping process (could also be presented as 4L). This degree of surface roughness or, in other words, increased surface smoothness, of the anvil roller(s) 10 and/or the equalizer roller 300 may provide for increased consistency of the cutting space 17, and thereby improve cutting depth precision, in certain preferred apparatuses of the present invention. For the sake of completeness, it should be added that average roughness (Ra) is one of the typical ways to measure surface imperfection. Roughness includes the finest (shortest wavelength) irregularities of a surface. It generally results from a particular production process or material condition. Typical grinding methods can achieve a minimum Ra of 8 micro-inches (or 0.2 μm). Other finishing processes are typically used to achieve lower values. For instance, a Ra of 4 micro-inches (or 0.1 μm) can be achieved using a finishing lapping process. Average roughness Ra is one of the typical ways to measure surface imperfection. Other production processes, other measurements and/or other scales could be used without affecting the teachings of the present invention.

In certain embodiments of the present invention, the anvil roller 10 and/or the equalizer roller 300 comprise fully hardened tool-grade steel. In certain preferred embodiments, the surface of the equalizer roller 300 and/or the anvil roller 10 have an average surface hardness of approximately equal to or greater than 65 on the Rockwell C scale.

In a kit according to one embodiment of the present invention, several anvil rollers 10 of differing diameters are provided (e.g., overcut and undercut). In a preferred embodiment, five anvil rollers 10, sequentially differing in radius by 3 micrometers, are provided. This kit may therefore be used to replace the smallest anvil roller 10 up to four times as the cutting surface 27 is sequentially worn down by use. The kit may or may not include the equalizer roller 300.

By employing the sequentially sized anvil rollers 10 according to certain embodiments of the present invention as described above, a single cutting surface 27, for example on a single die plate, may be used for an extended period of time, while maintaining an expected cutting depth precision. Extending the effective lifespan of the cutting surface 27 in this way may advantageously result in reduced cutting surface or die plate replacement costs.

FIGS. 4A, 4B, 4C, 4D and 4E present schematic representations of elevation views depicting other exemplary apparatuses A, B, C, D and E according to exemplary embodiments of the present invention. The purpose of FIGS. 4A to 4E is to exemplify some of the different configurations that are expected to provide at least some of the exemplary advantages mentioned herein. Skilled persons will readily understand that FIGS. 4A to 4E do not present all the different configurations that are expected to be workable. Likewise, skilled persons will be able to identify permutations of the different options between the FIGS. 4A to 4E that are also expected to be workable. As depicted in FIG. 4A, the cutting roller 16 may be supported by the anvil roller 10 and the first support roller 20. FIG. 4B shows that the positions of the anvil roller 10 and the first support roller 20 are interchangeable and that the cutting roller 16 may have a diameter smaller than that of the other rollers. The diameter of the anvil roller 10 and the diameter of the first support roller 20 may also be different from one another (not shown). Figure C shows that the anvil roller 10 may be further supported (by rollers 26 and 28) while the first support roller 20 is not. The opposite (not shown) could also be provided. FIG. 4D shows both the anvil roller 10 (by rollers 26 and 28) and the first support roller 20 (by rollers 30 and 32) being further supported. FIG. 4D further shows that the different support rollers 20, 26, 28, 30 and 32 may not be of the same dimension and that the cutting roller 16 may be of greater diameter than, for instance, the anvil roller 10. While only the roller 26 is shown as being of a smaller diameter, skilled persons will readily understand that various combinations of roller sizes could be provided. The FIG. 4E shows that only the first anvil support roller 28 may be provided (i.e., without the second anvil support roller 26). While it is not shown, only one of the two rollers 30 and 32 may also be provided.

Figure 5:
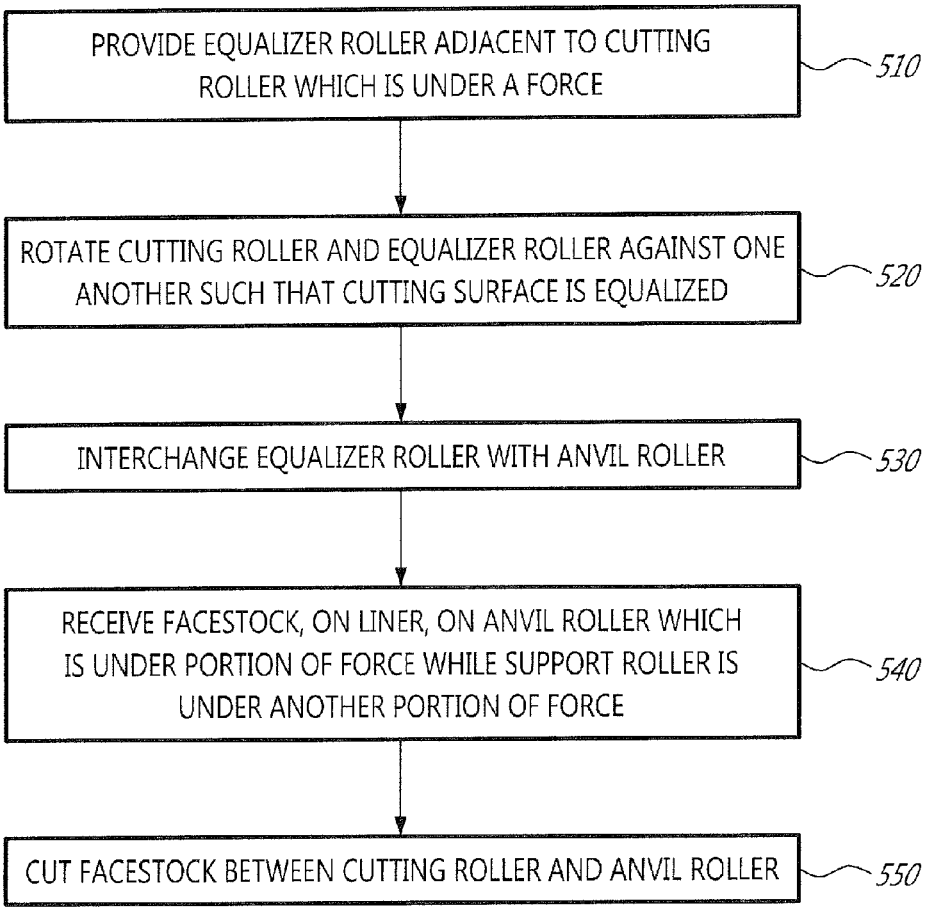
FIG. 5 is a flow chart depicting an exemplary method according to an embodiment of the present invention.

FIG. 5 is a flowchart that depicts an exemplary method 500 of cutting facestock 12 according to a preferred embodiment of the present invention. As a first step of the method 500, an equalizer roller is provided adjacent to a cutting roller, which is under a force (510). Thereafter, the cutting roller and the equalizer roller are rotated (e.g., at least once, but typically two (2) times) against one another such that a cutting surface of the cutting roller is equalized (520). The equalizer roller is then interchanged with an anvil roller (530). A facestock on a liner is then received, on the anvil roller, which is under a portion of the force while a support roller is under another portion of the force (530). The method 500 concludes by cutting the facestock between the cutting roller and the anvil roller (540).

In embodiments of the present invention where the cutting surface is equalized otherwise than by an equalizer roller, steps 510, 520 and 530 may be omitted. In embodiments of the present invention for preparing the cutting surface of a cutting roller with an equalizer roller, steps 530, 540 and 550 may be omitted.

The combination of (i) the stability of certain preferred apparatuses of the present invention, which stability is at least partly achieved by the different contact surfaces 19, 21 and 23, which allow application and distribution of the force 18 throughout the apparatus 1 in a controlled manner and (ii) the cutting depth precision at least partly achieved by the use of the equalizer rollers 300 of certain embodiments of the present invention to equalize the cutting surfaces 27, provide surprising results. For example, facestock 12 may be cut in certain apparatuses and methods of the present invention at speeds of up to approximately 750 feet per minute. Also, as discussed hereinabove, certain preferred apparatuses and methods of the present invention, which combine use of equalizer rollers 300 with the stability provided by different contact surfaces, allow for the thin and very thin liners 14 having thicknesses less or equal to 23 micrometers, 18 micrometers, or 12 micrometers.

The embodiments of the invention described above are intended to be exemplary only. As will be appreciated by those of ordinary skill in the art, to whom this specification is addressed, many obvious variations, modifications, and refinements can be made to the embodiments presented herein without departing from the inventive concept(s) disclosed in this specification. The scope of the exclusive right sought by the applicant is therefore intended to be limited solely by the appended claims.

What is claimed is:

1. An apparatus for cutting a facestock on a liner, the apparatus comprising:

an anvil roller for receiving the facestock on the liner;

a cutting roller under a force for cutting the facestock between the cutting roller and the anvil roller;

a first support roller for directly supporting the cutting roller such that the first support roller is under a first portion of the force while the anvil roller is under a second portion of the force; and a second support roller and a third support roller for directly supporting the first support roller such that the second support roller is under a first subportion of the first portion of the force while the third support roller is under a second subportion of the first portion of the force.

2. The apparatus of claim 1, further comprising a first anvil support roller and a second anvil support roller for directly supporting the anvil roller such that the first anvil support roller is under a first subportion of the second portion of the force while the second anvil support roller is under a second subportion of the second portion of the force.

3. The apparatus of claim 2, wherein the axes of rotation of the first and second anvil support rollers are, with respect to the force, below the axis of rotation of the anvil roller.

4. The apparatus of claim 1, wherein the axes of rotation of the second and third support rollers are, with respect to the force, below the axis of rotation of the first support roller.

5. The apparatus of claim 1, further comprising a force imparting member for imparting at least some of the force onto the cutting roller, wherein the force imparting member comprises at least one pressure roller for directly imparting at least some of the force onto the cutting roller.

6. The apparatus of claim 1, wherein the cutting roller comprises a cutting surface for cutting the facestock and a contact surface for engaging an anvil contact surface on the anvil roller and for engaging a support contact surface on the first support roller, wherein the facestock is cut in a space between the anvil roller and the cutting roller, and wherein the space has a thickness that allows the facestock to be cut while not cutting through the liner.

7. The apparatus of claim 1, configured such that the axis of rotation of the cutting roller is substantially horizontal.

8. The apparatus of claim 1, wherein the cutting roller is a die-cutting roller that comprises a magnetic cylinder and a die plate for magnetically engaging the cutting roller and forming a cutting surface thereon.

9. The apparatus of claim 1, wherein the axis of rotation of the anvil roller and the axis of rotation of the first support roller are, with respect to the force, below the axis of rotation of the cutting roller.

10. The apparatus of claim 1, wherein at least one of the anvil and the cutting roller is removable from the apparatus.

11. The apparatus of claim 1, further comprising an equalizer roller for equalizing a cutting surface of the cutting roller, the equalizer roller having an equalizing surface having a hardness at least as hard as a hardness of the cutting surface, wherein the equalizer roller is adapted to be positioned adjacent to the cutting roller.

12. The apparatus of claim 11, wherein the equalizer roller is adapted to be positionally interchangeable with the anvil roller.

13. An apparatus for cutting a facestock on a liner, the apparatus comprising:

an anvil roller for receiving the facestock on the liner;

a cutting roller under a force for cutting the facestock between the cutting roller and the anvil roller;

a first support roller for directly supporting the cutting roller such that the first support roller is under a first portion of the force while the anvil roller is under a second portion of the force;

a second support roller and a third support roller for directly supporting the first support roller such that the second support roller is under a first subportion of the first portion of the force while the third support roller is under a second subportion of the first portion of the force; and a first anvil support roller and a second anvil support roller for directly supporting the anvil roller such that the first anvil support roller is under a first subportion of the second portion of the force while the second anvil support roller is under a second subportion of the second portion of the force.

14. The apparatus of claim 13, further comprising an equalizer roller, adapted to be positionally interchangeable with the anvil roller, for equalizing a cutting surface of the cutting roller, the equalizer roller having an equalizing surface having a hardness at least as hard as a hardness of the cutting surface, wherein the equalizer roller is adapted to be positioned adjacent to the cutting roller.

* * * * *